US006145260A

United States Patent [19]

Morton

[11] Patent Number: 6,145,260

[45] Date of Patent: Nov. 14, 2000

[54] WALL REINFORCING AND WATERPROOFING SYSTEM AND METHOD OF FABRICATION

[75] Inventor: Steven E. Morton, Pickerington, Ohio

[73] Assignee: Engineered Composite Systems, Inc., Pickerington, Ohio

[21] Appl. No.: 09/250,506

[22] Filed: Feb. 16, 1999

[51] Int. Cl.[7] ..... E04B 1/14

[52] U.S. Cl. ..... 52/293.2; 52/293.3; 52/309.1; 52/506.01; 52/506.05; 52/736.3; 52/738.1; 52/741.3; 52/746.1; 52/DIG. 7

[58] Field of Search ..... 52/309.1, 309.2, 52/506.01, 506.05, 630, 736.3, 737.4, 738.1, 741.3, 741.41, 746.1, DIG. 7, 293.2, 293.3

[56] References Cited

U.S. PATENT DOCUMENTS

| | | | |
|---|---|---|---|
| 4,757,651 | 7/1988 | Crites | 52/293.2 X |
| 4,916,874 | 4/1990 | McCoy et al. | 52/293.2 X |
| 4,970,835 | 11/1990 | Harmon | 52/293.2 X |
| 5,640,825 | 6/1997 | Ehsani et al. | 52/746.1 |
| 5,649,398 | 7/1997 | Isley, Jr. et al. | 52/DIG. 7 X |
| 5,845,450 | 12/1998 | Larsen | 52/293.2 X |

*Primary Examiner*—Christopher T. Kent
*Attorney, Agent, or Firm*—Jason H. Foster

[57] ABSTRACT

A wall reinforcing system is provided for strengthening of walls formed of masonry or from wood, metal or other structural materials. A basic system comprises utilization of rigid, fiber reinforced polymer plates of a length to extend substantially the full vertical heigth of the wall. These plates incorporate a plurality of filamentary fibers of length to extend the full length of a plate with these fibers formed from carbon, glass or other material exhibiting high tensile strength and are affixed in a cured polymer matrix. A number of these plates are securely fixed to a wall in spaced parallel relationship by a resin bonding agent or by mechanical fastening devices, or by a combination of both. A plate may include a plurality of plates secured in stacked, superposed relationship and ridgidly secured together by a resin bonding agent into a unitary structure. A second system utilizes one or more sheets of flexible fabric-like material that is fabricated with tows of high tensile strength filamentary fibers of carbon, glass or other material. This fabric-like material is secured to the wall by a resin bonding agent with the tows vertically oriented thus utilizing their tensile strength for strengthening of the wall, either alone or in combination with the plates, and providing waterproofing.

24 Claims, 7 Drawing Sheets

WALL REINFORCING AND WATERPROOFING SYSTEM AND METHOD OF FABRICATION

FIELD OF THE INVENTION

This invention relates, in general, to technique for reinforcing walls that may be masonry of either the solid, unitary cast concrete construction type or the laid-up, modular block type, or which may be constructed of wood, metal or other material. More specifically, it relates to applying elongated, rigid, fiber reinforced polymer plates in a cured state to an external surface of a wall of that type by a bonding adhesive either alone or in combination with adhesive resin bonded fibers fabricated in sheet-form in a wet layup state that effects both mechanical reinforcing and waterproofing. It also relates to thin sheets of fiber reinforced polymer applied to wall's surface by a bonding adhesive for providing both mechanical strengthening and waterproofing.

BACKGROUND OF THE INVENTION

Reinforcing of concrete masonry structures by means of exterior application of rigid metal plates to surfaces of such structures by mechanical fastening devices is a known practice. An example of this practice is illustrated in U.S. Pat. No. 5,640,825 issued Jun. 24, 1997 to Ehsani, Mohammad R., et al. These plates are utilized to subsequently attach the ends of elongated, flexible straps of sheet-form having short, randomly oriented non-metallic fibers with the straps secured in a horizontally disposed position to the wall's surface by an adhesive epoxy that is then cured. The metal plates engage with longitudinal end portions of the straps and are mechanically secured to adjacent structure which supports the wall.

It also is a known practice to strengthen load bearing concrete floors by use of carbon fibre reinforced polymer (CFRP) strips. This is accomplished through bonding of elongated strips of CFRP to the undersurface of horizontally disposed concrete floors with these strips counteracting tensile forces. These CRFP strips may also be utilized for strengthening roof sections to better accommodate roof loading generated by wind or by accumulations of snow, or combinations of wind and snow. The CFRP strips are applied in laterally spaced parallel relationship by use of a suitable adhesive. These strips may also be applied in overlying relationship to a previously applied set but disposed in orthoganal arrangement and adhesively bonded thereto but not to the surface of the concrete structure being strengthened.

Three additional previously issued U.S. patents disclosing related subject matter were noted as a result of investigating existing reinforcing techniques utilized in strengthening concrete structures. These patents are listed as follows:

[1] U.S. Pat. No. 5,308,430 issued May 3, 1994 to Saito, Makoto, et al.;

[2] U.S. Pat. No. 5,326,630 issued Jul. 5, 1994 to Saito, Makoto, et al.; and

[3] U.S. Pat. No. 5,447,593 issued Sep. 5, 1995 to Tanaka, Tuneo, et al.

Each of these three patents discloses a similar structural unit which provides the tensile stress resistive component for effecting strengthening of the concrete structural element to which it is applied. They each comprise a plurality of elongated fibers disposed in parallel aligned groups embedded in an uncured matrix of thermosetting resin in a sheet-form structure. This structural sheet is applied to a surface of the structural element to be strengthened by means of a thermosetting resin adhesive. The sheets are positioned on the structural element to obtain the most effective utilization of the tensile attributes of the fibers. Along with positioning of the fiber sheets with the resin, the entire mass is subjected to of ambient room temperature or application of heat at an elevated temperature appropriate to effect curing of the matrix and adhesive resins.

Another technique previously used in effecting strengthening of walls comprises utilization of a plurality of elongated structural steel beams vertically disposed in spaced parallel relationship along the inwardly facing surface of a wall. These beams are of a size and cross-sectional configuration to have sufficient strength to counteract inward flexing of the wall that would otherwise result from any unexpected excessive increase in horizontally directed forces applied to the exterior or outwardly facing surface of the wall. Each of the beams, which may be of "I", "T", "L"-shaped angle, "C"-shaped channel or other suitable configuration, has a flat-surfaced component that is positioned in contacting engagement with the wall's surface. The upper end of each beam is mechanically secured to an overlying joist and the bottom ends are fixed to the floor which,, in a basement wall strengthening situation, is typically formed of concrete. A typical technique of securing a beam to a concrete floor comprises forming a socket in the floor for each beam, inserting the beam's lower end in a respective socket, filling the socket with concrete which is permitted to harden thereby holding the beam upright and against the wall, and then securing the upper end to a joist. This technique results in a structure that is not only objectionably intrusive into a basement's interior space but, is a costly and time consuming procedure.

SUMMARY OF THIS INVENTION

A major aspect of this invention is providing a technique of strengthening vertically disposed masonry walls to increase their ability to resist laterally directed forces that may be applied to one surface of the wall. One principle technique and its modifications are specifically adapted to enhance the lateral strength of basement walls of residential homes in addition to similar walls of commercial buildings. These walls are generally substantially, if not completely, subterraneanly disposed with the earth surrounding the building disposed against the exterior surface of the wall. While that earth adjacent the wall exerts a downward force resulting from its weight, it also exerts a substantial lateral force which increases in proportion to the increase in vertical depth. Although this lateral force is otherwise opposed and counteracted by the adjacent soil, this situation does not prevail with respect to the wall having the earth bearing against its exterior surface. It is the wall that must be capable of counteracting the laterally directed forces generated by the adjacent earth in contacting engagement with the wall's exterior surface. A factor that must be considered in determining whether a wall has sufficient strength to resist the lateral forces is the amount of water that may be present in the earth at any given time. An increase in the water content will increase the lateral force exerted against the wall and is an indeterminate and usually variable factor.

A basic embodiment of this invention comprises a rigid, fiber reinforced polymer plate of elongated configuration that is adhesively bonded to an interior surface of a masonry wall to effect strengthening thereof to resist horizontally directed forces applied to its opposite exterior surface. The plate is relatively thin compared to its width and is positioned in a generally vertical orientation with one of its flat surfaces placed in coplanar relationship to the wall's surface to which it is bonded by an intervening layer of an adhesive bonding agent. The plate is of a length to extend the full height of the wall. For a wall of substantial length a plurality of plates are used with the plates being disposed in spaced parallel relationship along the length of the wall. Spacing of the plates and the number required for a given length of wall is dependent upon the maximum expected earth and water loading forces to be applied horizontally against the exterior surface of the wall. Other factors entering into this determination are the thickness and width of the plates in addition to the vertical height of the wall.

Fabrication of the reinforcing plates of this invention comprises embedding a layer of carbon or glass or other reinforcing fibers in a matrix of resin which can be vinylester, polyester, epoxy or other type and then curing the resin resulting in formation of a rigid plate having a predetermined structural strength. The fibers are oriented in parallel relationship and of a length to extend the full longitudinal length of the plate being fabricated. A plurality of layers of fiber may be embedded in the resin matrix thus forming a plate of desired thickness and strength. Alternatively, some of the layers of fiber may be disposed in diagonal relationship to adjacent layers of longitudinally extending fibers thereby enhancing lateral shear strength of a plate. Reinforcing plates fabricated in accordance with this invention may be of various thicknesses to provide the desired tensile strength for a particular application and may be in the range of 0.05 inch to approximately three-sixteenth inch.

Enhancement of the strength of securing the plates to the wall is achieved by mechanical anchoring of the plates to the wall at their top and bottom ends through use of fastening devices in combination with anchor plates. These anchor plates may be square sections of the reinforcing plate placed in overlying relationship to the outwardly facing surface of the plates and secured thereto by an adhesive bonding agent. Rectangular sections of the reinforcing plate may also be used thereby distributing the anchoring force over an elongated length of a plate. Anchor plates may be used singly or they may be used in stacked pluralities such as two or three. The anchoring plates may be positioned in various orientations with respect to their reinforcing fibers. While use of anchoring plates enhances the securing strength for the plates, it is to be understood that additional securing strength provided by anchor plates may not be required for all installations and reliance placed solely on the adhesive bonding agent for securing a plate to a wall.

In a second embodiment of this invention the carbon or glass or other reinforced fibers are formed into a fabric-type sheet of material. The fibers are disposed in parallel, closely adjacent relationship forming a layer that is secured together by transversely extending fibers that are formed of carbon, glass or other high tensile strength material. This sheet is designed to be positioned in coplanar, overlying relationship to the interior surface of the masonry wall to which it is secured by a bonding resin thereby providing waterproofing in addition to strengthening the wall to resist the laterally directed forces generated by the earth and water combination and exerted against the exterior surface of the wall.

Although the waterproofing sheet can be utilized by itself as described in the preceding paragraph it is advantageously used in combination with the rigid, fiber reinforced polymer plates. After application of the plates, the waterproofing sheet is applied. It may either be applied in a single continuous sheet that overlies the vertically extending plates or it may be applied in sections that interfit between adjacently disposed pairs of the plates. Regardless of the technique of application, the combination provides significant enhancement of the strengthening effect along with the added advantage of providing waterproofing.

These strengthening and waterproofing sheets may be used in single sheets with their tensile strength characteristic oriented in vertical relationship to the wall which provides the most desired enhancement of wall strengthening. However, a plurality of similarly fabricated sheets may be applied in superposed, overlying relationship with the tensile strength enhancing fibers of all sheets oriented in the same vertical direction. An adhesive bonding resin is utilized in both securing a first sheet to the wall and in bonding the fibers in the sheet together as the resin will extrude through the spaces between the fibers as the sheet is pressed against the wall. Similarly, an adhesive bonding agent is applied to the outer surface of a previously applied sheet and bonds the next sheet to the prior sheet in addition to being extruded between the fibers of this next applied sheet as it is pressed against the prior sheet.

The additional sheets may be positioned with their longitudinally extending reinforcing fibers oriented at various angles with respect to the vertical dimension of the wall. One common other orientation would have the fibers extending in a horizontal plane thereby enhancing the resistance to tension stress forces exerted in a horizontal direction.

Utilization of this invention is particularly advantageous with masonry walls but its utility is not limited to those walls. The strengthening waterproofing elements may be used with the walls of structures fabricated from other materials such as, for example, wood or metal.

These and other objects and advantages of this invention will become more clearly apparent from the following detailed description of illustrative embodiments of the invention and the accompanying drawings.

DESCRIPTION OF ILLUSTRATIVE EMBODIMENTS

Figure 1:
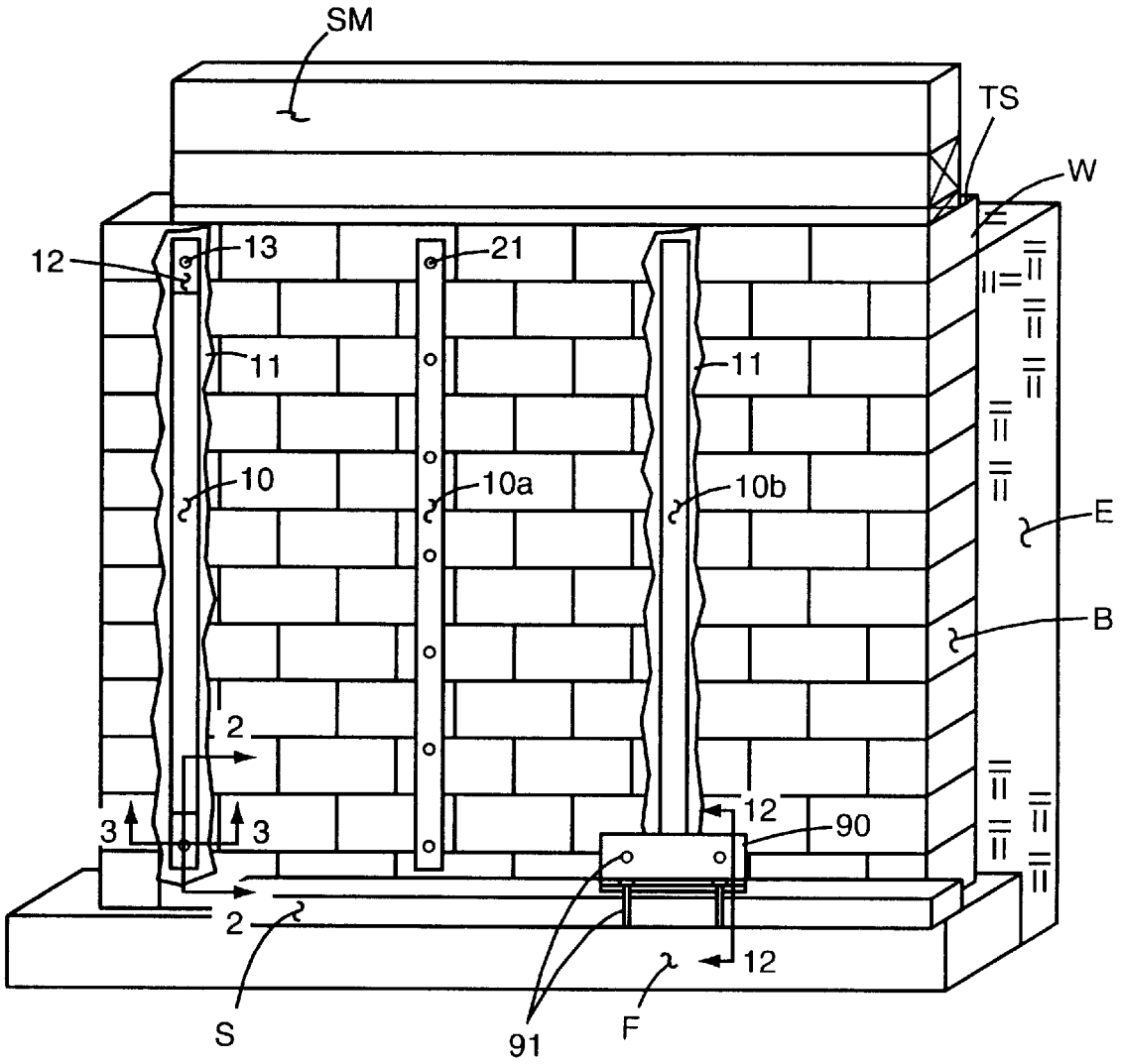
FIG. 1 is a fragmentary perspective view of a masonry wall having strengthening plates embodying this invention affixed thereto.

Referring to the drawings, and in particular to FIG. 1 for this introductory description of an exemplary installation, a portion of a typical basement wall W of a residential building is shown as constructed in the known customary environment. That environment includes a footer F commonly fabricated from concrete and extending around the periphery of the building's excavation. It is normally rectangular in transverse cross-section with an upper horizontal surface of greater width than the wall's thickness with the wall being built on that surface. The wall has a vertically extending interior surface IS and an outwardly facing exterior surface (not shown) which abuts the earth E that is filled in the excavated space after the wall is constructed. This earth illustrated in FIG. 1 is to be understood as being a continuation of a larger body of earth that surrounds the building providing in combination the horizontal forces directed laterally against the wall's exterior surface and must be resisted by the wall. Recognition must also be given to the lateral force that is added by any ground water which may be present. For a more complete illustration of the basic building structure as it relates to the basement wall W, the initial structural members SM are shown positioned on and secured to the top surface TS of the wall around its perimeter. Also shown in the perspective views of these typical basement walls W is a section of a basement floor slab S having a peripheral marginal edge portion that rests on the footer F and is in abutting engagement with the wall.

Regardless of the particular construction technique employed in forming of a masonry wall W, whether it is solid poured concrete or the modular concrete block-type with the individual blocks or portions thereof designated by the letter B as shown in the drawings, these walls are generically termed masonry walls. Either type of construction may at some subsequent time become or be found structurally inadequate to satisfactorily resist the forces generated by the weight of the earth and ground water and laterally directed against the exterior surface of the wall W. There are many diverse factors which, either individually or collectively, can cause a wall to become structurally inadequate to resist the forces exerted against its exterior surface thus requiring some remedial action to prevent or lessen the likelihood of serious damage or possibly catastrophic failure.

Figure 2:
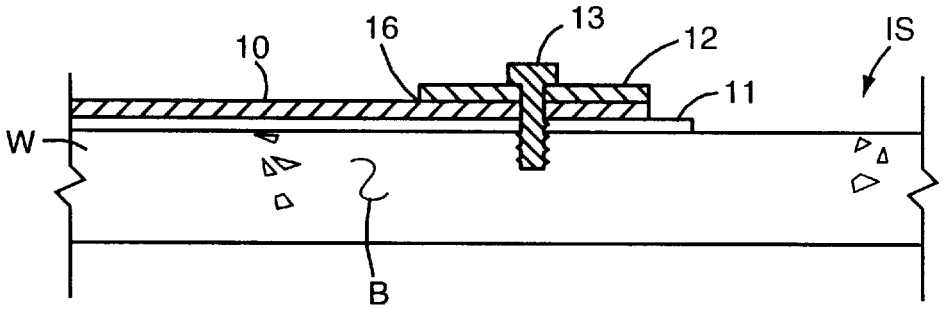
FIG. 2 is a fragmentary side view on an enlarged scale of a terminal end portion of a plate and associated portions of the wall as seen along line 2—2 of FIG. 1.

It is the primary objective of this invention to provide an effective technique of strengthening masonry walls of the type herein described after they have been constructed. This is accomplished by applying components to the interior surface IS of a wall W thereby avoiding relatively costly work on the exterior of the wall. Referring to FIG. 1 it will be seen that three elongated plates 10, 10*a* and 10*b* have been affixed to the wall in vertically disposed, spaced parallel relationship. Securing of the plates to the wall is primarily effected by use of a bonding resin 11 applied to the wall's surface in a thin layer as best seen in FIG. 2 covering an area that is at least equal to the surface of the plate that will face the wall. With the bonding resin applied and prior to it becoming cured, the plate is firmly pressed into position against the wall in overlying relationship to the bonding resin with sufficient pressure to assure an effective bond.

It is to be understood that only a portion of a wall is shown and that additional plates would be similarly affixed to the remainder of the wall. Although the plates on a same wall are most likely of the same construction, they may be different and relatively spaced apart at different distances. Typically, the plates 10 on a same wall are of the same construction and size and are of a length to extend the full height of the wall from the upper surface of the floor slab S to the top surface TS of the uppermost tier of blocks B. These plates are of an exemplary width of four or three inches and thickness of 0.05 inch. The height of the wall W is generally seven and one-half feet to eight feet in a residential building but that is not a determinative criteria for practice of this invention. Similarly, the length and width of the modular blocks B are not relevant factors. However, the height of the blocks and the height of the wall are relevant factors in determining the spacing of the plates along a wall. The width and thickness of the plates also are relevant factors which are concurrently considered with the heights of the blocks and of the wall in determining spacing of the plates.

These plates 10 are designed to resist tensile forces applied along their longitudinal axes. They are rigid, fiber reinforced polymer plates that may either have the fibers disposed unidirectionally or multi-directionally. If the fibers are unidirectional, they are disposed in parallel relationship to the plates longitudinal axis to effect maximum tensile strength. With the fibers disposed in multi-directions, they are disposed in layers wherein the fibers in each respective layer are positioned unidirectionally and adjacent layers are oriented with their respective fibers positioned in predetermined angular relationships. A specific objective of the multi-directional fiber type of plate construction is to enhance the capability of transferring shear forces by means of a mechanical fastener. Further explanation of the plate structure will be given in subsequent paragraphs.

Figure 3:
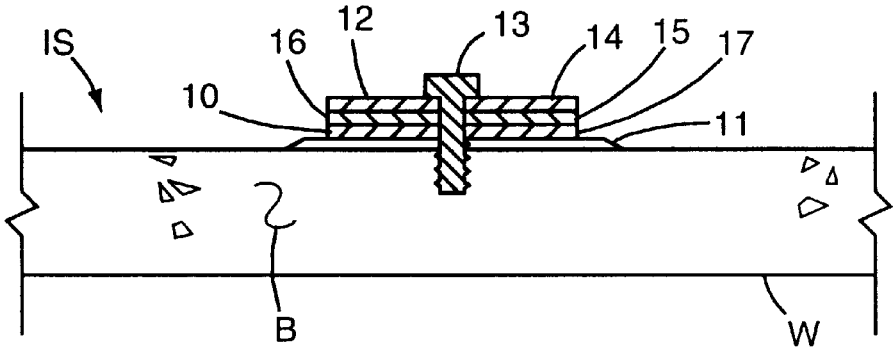
FIG. 3 is a sectional view on an enlarged scale taken along line 3—3 of FIG. 1.

Increased strength in securing the plates 10 to the wall W is effected by utilization of anchor plates 12 which are positioned at the upper and lower marginal ends of each plate. These anchor plates comprise short lengths of rigid, fiber reinforced polymer plates that may be either of the same or a different construction than the underlying strengthening plate 10. An attaching device, such as a mechanical fastener 13 adapted to be anchored into a receiving socket bored in the block, is projected through aligned apertures in the anchor plate and in the reinforcing plate 10 and extends into the underlying block B of the wall W with which it effects mechanical interconnection as can be best seen in FIG. 3. This particular anchor plate includes two plate elements 14 and 15 which are of the same construction as the plate 10. However, the anchor plates may not only be of different thickness as between the anchor plates but also with respect to the plate 10. A bonding adhesive is placed in respective layers 16 and 17 between the plates to form a bonded unitary structure for enhanced strength. This anchor plate 12 includes two plate elements 14 and 15 but it could have one or more than two as is necessary to meet the structural strength requirements of a specific installation.

Figure 4:
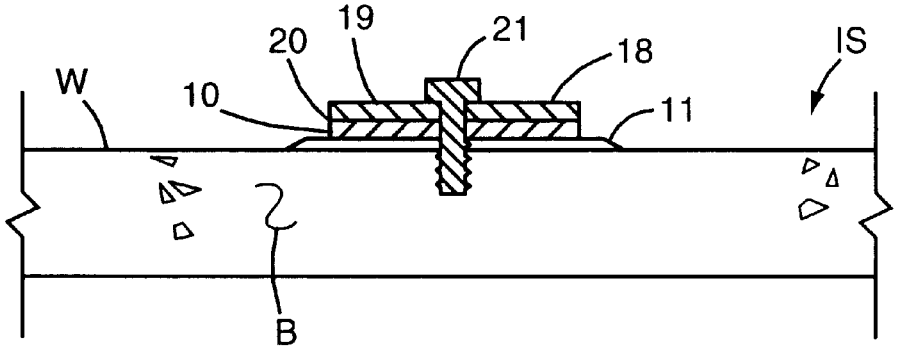
FIG. 4 is a sectional view similar to FIG. 3 but of a modified plate and anchor plate combination.

A modified anchor plate 18 is shown in FIG. 4. It comprises a single plate element 19 positioned on the exterior surface of the strengthening plate 10 to which it is adhesively bonded by an intervening layer of bonding adhesive 20. This results in a rigid unitary structure that is secured to the underlying block B by a mechanical anchor 21 projecting through aligned apertures formed in the strengthening and anchor plates and extending into the block providing a mechanical interconnection therewith to thereby effect transfer of transverse shear forces. The plate element 19 may be of a construction to more effectively transfer forces exerted transversely to the longitudinal axis of the strengthening plate 10 thus producing improved anchoring. This is also true with respect to the anchor plate 12 shown in FIG. 3 as will be further explained in the following paragraphs describing in greater detail the structure of a rigid, fiber reenforced polymer plate as shown in more extensive detail in FIG. 5.

It has been previously noted that these strengthening plates 10 are advantageously secured to a wall W by means of a bonding adhesive in combination with anchor plates 12 and mechanical fastening devices 13. These fastening devices extend through aligned apertures in the plates 10 and 12 and into respective sockets bored in the underlying block B in which they are mechanically secured. But, as was also previously noted, there are other techniques of securing the strengthening plates to a wall with two of these alternative techniques shown in FIG. 1. A first alternative is the center plate identified as 10*a* which is secured to the wall by a plurality of the mechanical fastening devices 21 and may also be secured by an adhesive bonding agent. Each device is inserted through a respective aperture in the plate and into a respective socket formed in an underlying block in which it is mechanically secured. All of the devices 21 are shown longitudinally aligned but it will be understood they be in a laterally offset arrangement. The number of devices utilized in securing of a plate may be other than as is shown. The second alternative is shown by the plate 10*b* at the right side of FIG. 1. This plate is secured solely by an adhesive bonding agent. The type of plate attachment utilized is dependent on the mechanical requirements of a particular installation.

Figure 5:
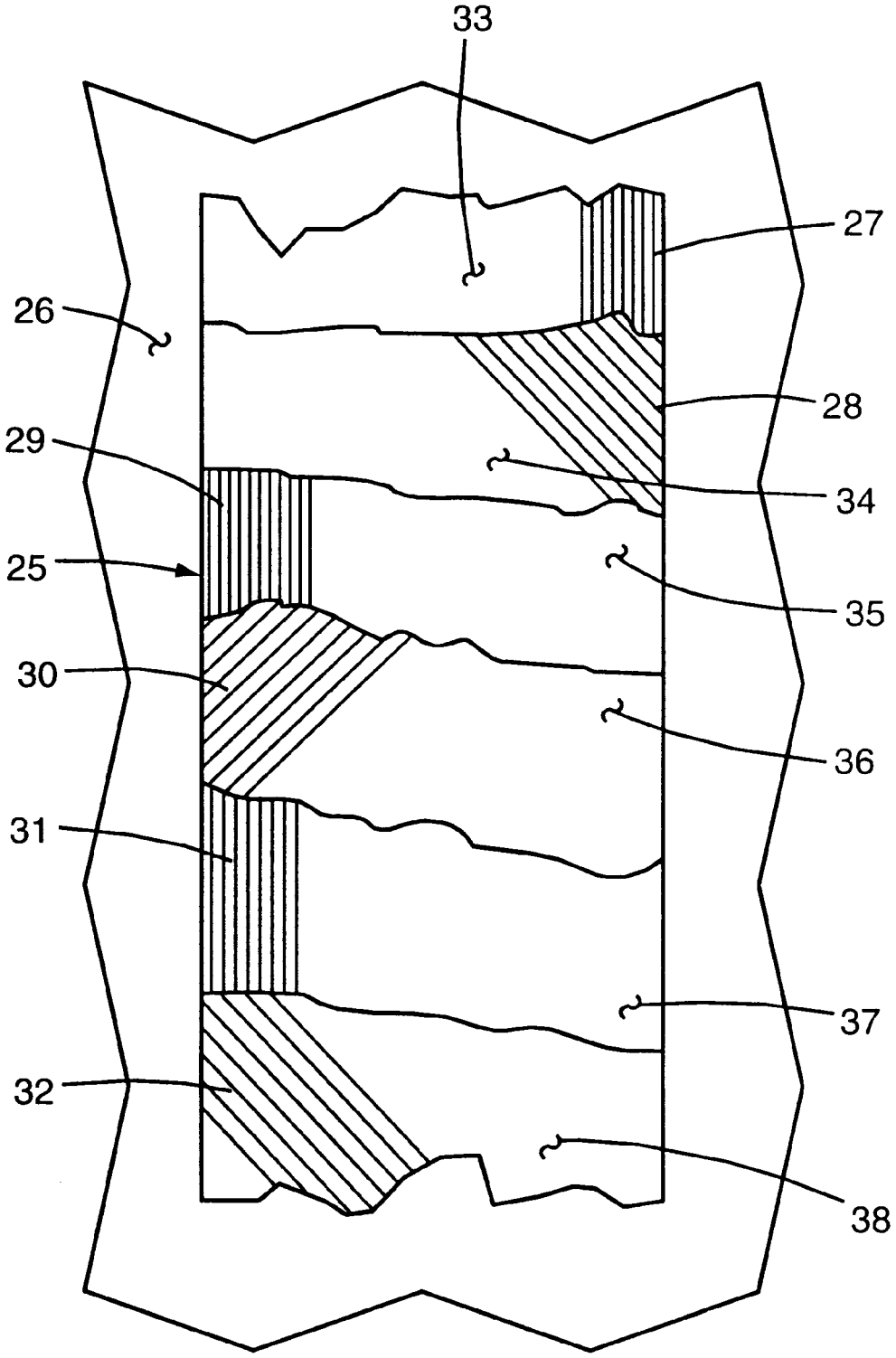
FIG. 5 is a fragmentary top plan view on an enlarged scale of the plate shown in FIG. 1 with portions thereof removed for clarity of illustration.

A short length of a multi-layered plate 25 embodying this invention is shown in plan view applied to an underlying masonry wall W in FIG. 5. This plate 25 may be mechically secured and/or adhered to the interior surface IS of the blocks B by a layer of bonding adhesive 26. The plate 25 is an exemplary design comprising six layers 27, 28, 29, 30, 31 and 32 of fibers that are each embedded in a respective bed 33, 34, 35, 36, 37 and 38 of polymer matrix with all of the matrix beds combined together into a unitary mass and cured thus forming the plate. FIG. 5 illustrates an exemplary design and a plate may be fabricated with a different number of layers in accordance with the design criteria of a particular plate to achieve a desired strength for a particular plate. It is to be noted this drawing figure is essentially diagrammatic as the fibers are of extremely small cross-sectional size and can be termed as being filamentary. Each of the layers comprises a multitude of fibers oriented in closely adjacent, parallel relationship whereby, in combination with the polymer matrix which adhesively bonds them together into a compacted mass, they form a unitary structure.

The numbered lines in the drawing represent the fibers and are intended to be illustrative of their direction of orientation in each respective layer with the fibers in a layer being unidirectional. These fibers are formed from carbon or glass or other suitable material which has high tensile strength. Alternate layers have their fibers either parallel to the longitudinal axis of the plate or angularly oriented thereto at a selected angle such as the illustrated 45 degree angle. An angularly oriented layer, such as layers 28, 30 and 32, is conveniently formed by placing short lengths from an elongated strip in adjacent coplanar relation. Their ends are cut at an appropriate angle to form an elongated strip with the ends of the short sections aligned to form an elongated strip having spaced parallel longitudinally extending edges that are aligned with the longitudinal edges of the next adjacent layer 27, 29 or 31. While the objective of the longitudinal orientation is to enhance a plates tensile strength, the angular orientation enhances a plates capability to resist shear forces acting in a direction transverse to a plates longitudinal axis or at some angle with respect to that axis. A transverse shear force is detrimental as it tends to laterally separate the longitudinal fibers resulting in an increase in the tensile stress to which they are subjected. In addition to providing resistance to shear forces the layers of angularly oriented fibers also provide resistance to longitudinal forces thereby increasing the tensile strength of a plate.

The number of layers of fibers forming a plate is dependant on the tensile strength that is required for a particular wall strengthening installation. Another factor that enters into this determination is the specific design of a particular plate. For example, the number of fibers included in a specific layer, its thickness and width in combination with its ultimate tensile strength enter into a plate's design. A plate may include a plurality of layers as illustrated in FIG. 5, or it may have a greater or lesser number such as even one as is the case with a subsequently illustrated and described embodiment, or the diagonally oriented layers in a plate may be disposed at different angles with respect to different layers of fibers in a specific plate.

Figure 6:
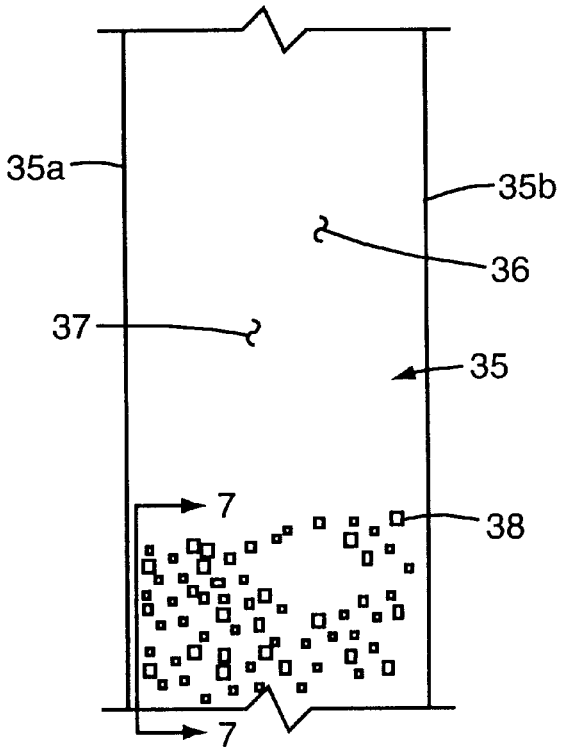
FIG. 6 is a plan view of a modified plate showing the surface thereof that is adhesively bonded to the surface of a wall.
Figure 7:
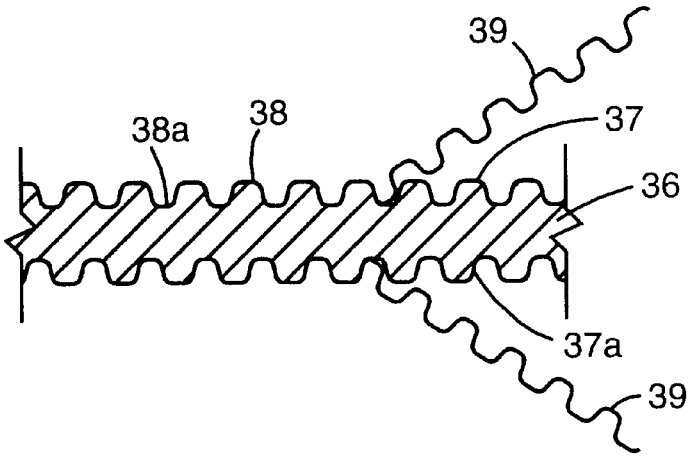
FIG. 7 is a transverse sectional view of the plate on an enlarged scale taken along line 7—7 of FIG. 6.

A modified plate 35 is shown in FIGS. 6 and 7 and includes a fiber reinforced polymer main body 36 which is a rigid structure formed by a pultrusion technique similar to that previously noted as being used in formation of the plate 10 in the FIG. 1 embodiment. This technique basically comprises pulling a group of a predetermined number of elongated, high tensile strength fibers of carbon, glass or other suitable material in parallel relationship through a forming die while concurrently extruding a polymer matrix through the die and in which the fibers are fixedly embedded when the polymer becomes cured. Another technique that is well adapted to formation of either a plate 10 or this modified plate 35 comprises placing the fibers embedded in an uncured polymer matrix in a forming cavity-mold which, in turn, is placed in an autoclave. The autoclave is operated with a vacumn and sufficient heat for the period of time required to effect curing of the polymer matrix.

The elongated plate 35 having spaced parallel longitudinally extending side edges 35*a* and 35*b* has a first flat surface 37 extending between those edges and is designed to be placed adjacent the interior surface IS of a wall W that is to be strengthened by the plate. Integrally formed with the plate's main body 36 are a multiplicity of conically shaped protuberances 38 which project laterally outward from its flat surface 37. These protuberances are disposed in close proximity to each other and may be either dispersed in a random arrangement or they may be positioned in an orderly arrangement of spaced parallel rows that extend either transversely or diagonally across the plate's surface. Also, the protuberances in adjacent rows may be offset laterally or they may be aligned in orthoganally disposed rows. In this illustrative embodiment the protuberances dimensionally are of the order of 1/32 inch in diameter at their base and are of the order of 1/32 inch in height and having a rounded apex. An objective of this modified plate 35 is that it enables use of a thick layer of adhesive bonding agent which enhances securing of the plate to a wall. This advantage is achieved by the increased surface area generated by the protuberances 38 thereby increasing the surface area to which the bonding agent can adhere and increasing the adhesive bonding and shear strength. The thickness of the layer of adhesive bonding agent is at least slightly greater than the height of the protuberances to avoid contact of their apexes with the surface of the wall to which the plate is to be affixed.

The plate 35 has a second surface 37*a* disposed at the side opposite the first surface 37 in parallel relationship thereto. This second surface may also be formed with protuberances 38 of the same configuration and arranged in the same manner as those formed on the first surface. Forming of the protuberances on both surfaces achieves two objectives. First, it effectively eliminates the likelihood of the plate curling out of its flat plane during the pultrusion forming operation, an undesired action which may well occur if the protuberances are formed on only the one surface. Secondly, a plate having both of its surfaces provided with protuberances is advantageous when another plate is to be positioned in overlying, superposed relationship thereto. It is particularly advantageous if the additional plate has protuberances formed on its surface that is disposed in facing relationship to the second surface 37*a* of the first mentioned plate. With that arrangement it is readily apparent the adhering surface area for the adhesive bonding agent will have been doubled. The layer of adhesive bonding agent is preferably of a thickness to prevent contact of the opposing protuberances, either at their conical sidewall surfaces or at their apexes. It is readily apparent that the modified plates 35 disclosed with respect to the embodiment shown in FIGS. 6 and 7 are particularly advantageous in fabricating a multilayer plate such as that shown in FIG. 5.

Forming of the protuberances 38 is accomplished by concurrently running a molding strip 39 through the pultrusion die with the polymer embedded fibers. The molding strip is formed with sockets 38*a* which are duplicative of the protuberances. It is fabricated from a material such as teflon to which the polymer does not adhere. Thus, after the plate 35 has been formed and the polymer cured, the molding strip may be readily stripped from the plate. Alternative devices for forming of the protuberances can include providing the pultrusion die with a roller or a revolving belt aligned with the pultrusion axis. The roller or the belt would be formed with sockets of a configuration to form the protuberances with the design of each respective type of forming apparatus taking into account the expected time for adequate curing of the polymer matrix.

Figure 8:
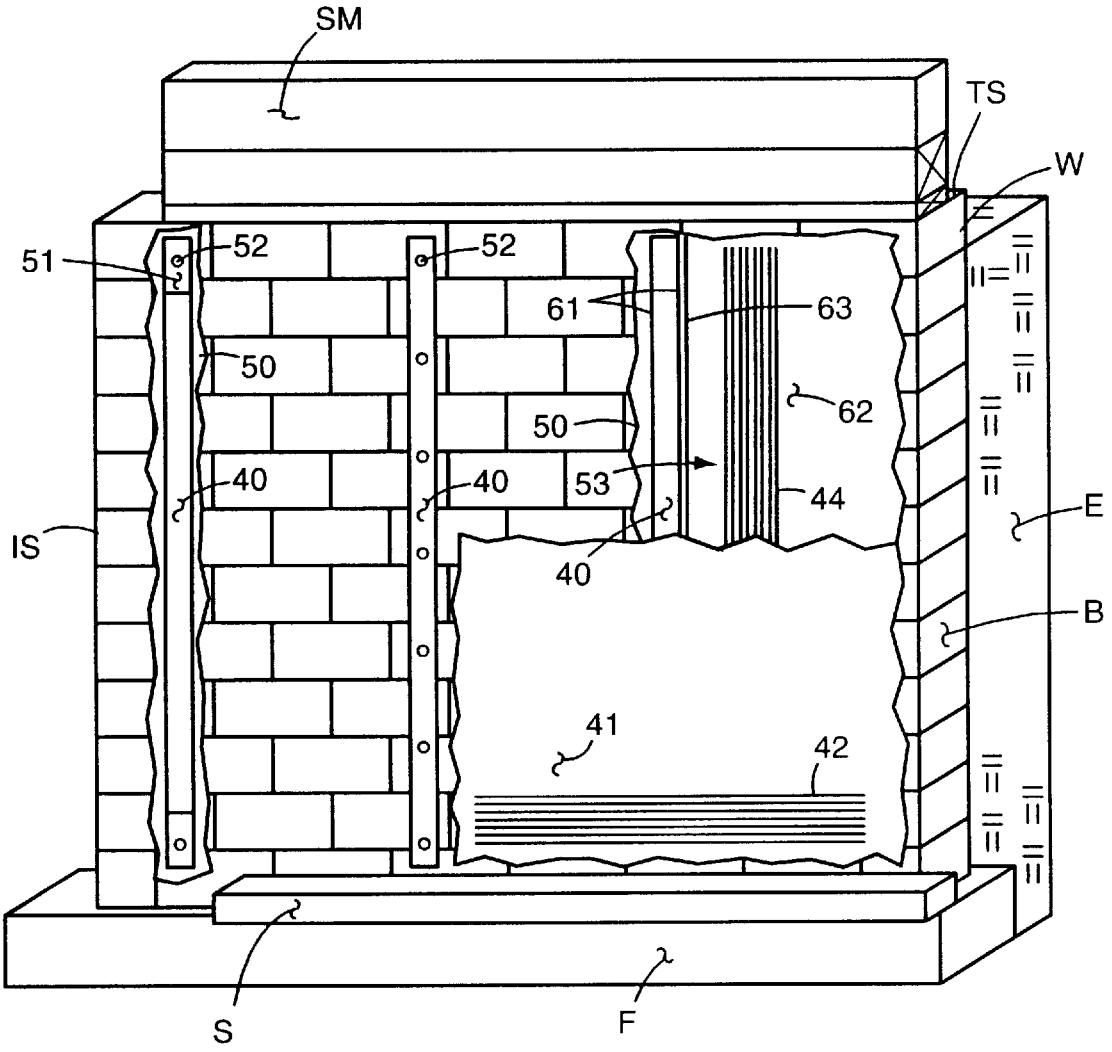
FIG. 8 is a fragmentary perspective view of a masonry wall having a strengthening plate and a waterproofing and strengthening sheet embodying this invention affixed thereto having the sheet oriented with its fibers extending vertically.

A modified strengthening system for a masonry wall W is shown in FIG. 8. This wall is also constructed with a plurality of modular concrete blocks B set on a footer F formed of concrete at the bottom of an excavation for a building structure. It has an interior surface IS of predetermined height terminating in a top surface TS extending around the perimeter of the building structure and on which the building's base structural member SM rests and is secured to the wall. The blocks B form an exterior surface (not shown) abutting the exterior mass of earth E which it retains by resisting the horizontally directed forces generated by the weight of the earth along with that of any ground water contained therein and directed laterally against the wall and tending to push it inwardly of the building's excavation.

Strengthening of a wall by this modified system is achieved by the combined effects of two distinct components that cooperatively provide vertically oriented tensile strength to the wall thereby aiding in counteracting the inwardly directed force generated by the earth E in combination with any ground water that may be present. These two components also cooperate in waterproofing the wall. One of these components is a plurality of elongated rigid, fiber reinforced plates 40 vertically disposed in spaced parallel relationship similar to the first embodiment shown in FIG. 1 and described with respect thereto. The second component is a thin waterproofing sheet 41 that overlies the plates and the entire interior surface IS of the wall to which it is adhered by a bonding adhesive. This waterproofing sheet is of a construction to have tensile strength and is oriented on the wall so that its tensile strength functions in a vertical direction thus cooperating with the tensile properties of the plates. The sheet 41 extends the full height of the wall thus not only providing complete waterproofing of the wall but aids in strengthening the wall throughout its entire length. It is to be understood that only a relatively short length of a wall is shown and a conventional residential basement wall would be of a length requiring more than two rigid, fiber reinforced polymer plates with their transverse sectional configuration and size along with their lateral spacing based on the strengthening required for a specific wall.

Application of this modified strengthening system shown in FIG. 8 is initiated by first preparing the interior surface IS of the wall W. This requires thoroughly cleaning the surface to remove dirt in addition to all particles of the concrete modular blocks B that may not be securely adhered to a block in addition to projections of concrete from the blocks and any mortar that may have inadvertently been applied to surfaces of the blocks. Mortared joints between blocks must be smoothed to either remove outwardly projecting components of mortar and to fill in holes that may exit in the joints as well as the blocks surfaces to produce a smooth surface. A smooth surface is desired to avoid possible voids between the wall and either the plates or the strengthening and waterproofing sheets that may not have sufficient adhesive applied to assure a continuous bond as well as avoiding puncturing of the sheets. This is also a time when cracks in a wall are repaired to further reduce the chance for water leaks. Preparation of the wall's interior surface as described is important to better assure secure attachment of the strengthening and waterproofing components to the wall.

Next, the rigid, fiber reinforced polymer plates 40 are affixed to the wall W. A layer of bonding adhesive 50 is applied to the wall in a strip that is at least equal in width to that of the plate and extending the full length of the plate. A plate is then placed in aligned relationship with the strip of adhesive and firmly pressed against it to effect bonding. Although the plates are shown as extending the full height of the wall, they may be of a lesser length and extend from the floor slab S to a height that is level with the top of the earth E surrounding the wall or to a point where the lateral forces exerted by the earth are of little or no consequence. Anchor plates 51 are also applied, where necessary, to the upper and lower marginal ends of the plates to provide additional strength in securing of the plates to the wall. As described with respect to FIG. 1, application of the anchor plates is effected by means of a bonding adhesive applied to the surfaces of each anchor plate that is to be placed in contacting engagement with each other anchor plate or the strengthening plate. A securing device 52 is inserted through the aligned apertures in the plates and projected into an underlying block B effecting mechanical engagement therewith to aid in securing the plates together and securing the plate 40 to the wall in addition to aiding in effecting transfer of shear forces.

Application of the sheet 41 for waterproofing and strengthening of the wall is now initiated. First, a layer of bonding adhesive 53 is applied to the wall's interior surface IS. The adhesive is applied to sections of a wall in sequential increments beginning at one end of the wall, or other selected starting point, rather than to the entire wall at one time. This minimizes the time that any portion is not in engagement with a respective portion of the sheet thus limiting the time of exposure to air which will initiate drying. A sheet 41 is provided in a roll of selected length and of a selected width to cover the entire wall above the floor slab S. An end edge of the roll is placed in vertical alignment with the end of the wall, or any other selected vertical line starting point. With the end edge of the sheet perpendicular to its longitudinal side edges, that edge adjacent the floor slab will closely follow the bottom edge of the exposed portion of the lower tier of blocks thus assuring that the wall's surface will be entirely covered with the waterproofing sheet. The roll of the sheet 41 is unreeled to the extent necessary to substantially cover the wall section to which adhesive had been applied. As the segmental portion of the sheet is applied to the wall, the sheet is pressed tightly against the wall's surface and into the bonding adhesive 53. Some adhesive is likely to extrude through any spaces that may exist between adjacently disposed fiber tows thereby assuring that the tows form a continuous, uninterrupted sheet. This process is sequentially repeated until the entire wall, including the plates 40, is covered. Since the fiber tows forming the sheet 41 are not initially rigidly interconnected along their adjacently disposed longitudinal edges, the sheet will readily flex into conformance with the surfaces of a strengthening plate 40 resulting in further strengthening of those plates.

A modification in application of the waterproofing sheet 41 is shown in FIG. 8. A section of a wall W is shown provided with three vertically disposed strengthening plates 40 of the same construction as the similar plates shown in FIG. 1 and having opposed vertically extending side edges 61. A waterproofing sheet 62 of the same construction as that of sheet 41 previously described with respect to FIG. 8 is shown applied to the wall's interior surface IS. In this embodiment the sheet 62 is only applied to the wall's surface and does not extend over the plates. Each section of the sheet extends only between a pair of adjacently disposed pair of plates with the opposed vertically extending end edges of a sheet section abutting the respective side edge 61 of a plate. These sheet sections also are secured to the wall by a bonding resin. The sheets are oriented in the same manner as sheet with the fibers in the tows disposed in the exterior layer extending vertically thereby adding to the vertical tensile strength provided by the plates 40.

Another variation of this invention is illustrated in FIG. 8 which shows a fragmentary portion of a wall W similar to that as shown in FIG. 1. Three vertically disposed strengthening plates 40 embodying the same structure as that of the plates 10 shown and described with respect to FIG. 1 are similarly applied to the interior surface IS of the wall shown in FIG. 8 in spaced parallel relationship. Waterproofing sheets 62 and 41 are of the same construction as previously described. These sheets are applied in superposed relationship but are disposed in orthoganal relationship to each other although they could be oriented relative to each other at any selected angle. In this illustrative embodiment sheet 62 disposed next adjacent the wall's interior surface is oriented with its fiber tows 44 vertically disposed as indicated. It is adhered to the wall by a bonding resin and may either be applied in a continuous sheet extending the full length of the wall and overlying the plates 40 or it may be applied in sections which interfit between adjacent pairs of plates. Each of these techniques and their respective objectives attained have been previously explained.

The second sheet 41 is next positioned in superposed relationship to the sheet 62 in contact with the outwardly facing surface of sheet 62. It is secured thereto by a bonding resin thereby forming a unitary, two layer sheet that, in addition to enhanced waterproofing capability, improves the mechanical strengthening of the wall W. This second sheet is oriented with its fiber tows 42 disposed horizontally or at a selected angle to a horizontal line. In view of that orientation, the second sheet 41 is applied either in sections which interfit between adjacent pairs of plates 40 or overlapping the plates.

A particular advantage of this structure shown in FIG. 8 is its capability of strengthening the wall to counteract horizontal stress forces that can also result from lateral forces applied to the wall's exterior surface intermediate a pair of adjacent plates 40. While a wall is initially designed and constructed to withstand a predetermined lateral force that is customarily expected at the location of the building, those forces may change over a period of time after initial design of a wall. A subterranean wall, such as a basement wall, is often subject to deterioration that weakens the wall to an extent that cracks may develop resulting in a greater likelihood that inward bowing of the wall may occur leading to further deterioration.

Figure 9:
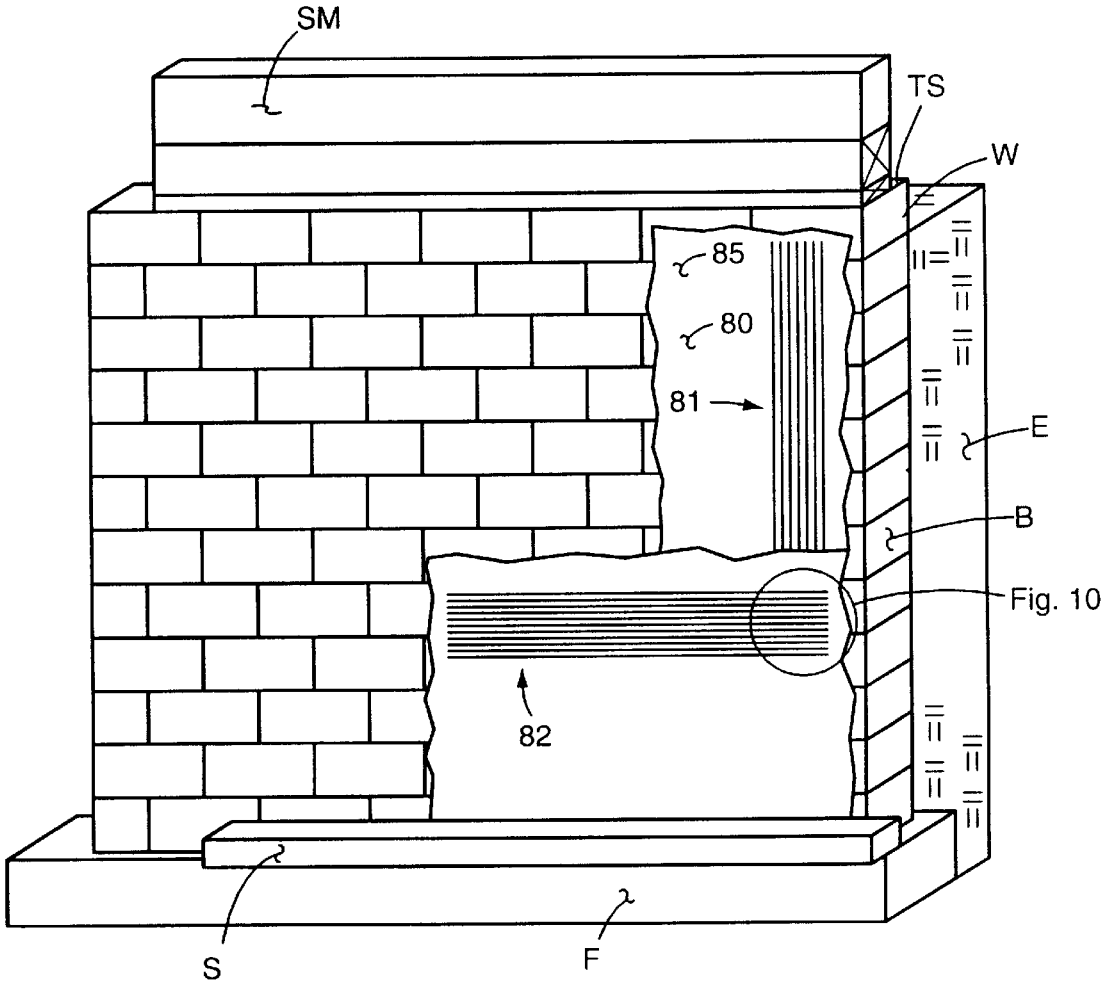
FIG. 9 is a fragmentary perspective view of a masonry wall similar to that shown in FIG. 8 except it has no strengthening plates embodying this invention affixed thereto but has two waterproofing and strengthening sheets of the construction shown applied thereto in a manner having reinforcing fibers extending both vertically and horizontally.

Another embodiment of the wall reinforcing technique of this invention is illustrated in FIG. 9 considered in combination with a wall W incorporating the basic structure of the walls which have been previously illustrated and described herein in conjunction with other embodiments of this invention. In this embodiment the wall is not provided with a plurality of rigid, fiber reinforced polymer plates 10 attached to its interior surface IS by a bonding adhesive and having anchor plates 12 in a manner similar to that shown and described with respect to the plates 10 in FIG. 1. This embodiment utilizes only strengthening and waterproofing sheets 80 which are secured to the interior surface of the wall. They are of a length to extend from the floor slab S to the top surface TS of the wall or to a lesser height for reasons as previously discussed with reference to other embodiments of this invention.

Reinforcing of the wall in accordance with this embodiment is provided by a sheet 80 that, in its original state, is of a dry, flexible construction having characteristics of a fabric. It is shown in FIG. 9. The sheet 80 is of a woven fabric construction that includes groups of elongated, high tensile strength, filamentary fibers fabricated from carbon, glass or other suitable material positioned in parallel relationship in groups which are disposed in spaced parallel relationship, a constructional arrangement of the high tensile strength filamentary fibers that have herein been referred to as "tows". Structure of a sheet 80 is subsequently described in detail with respect to FIG. 9. This sheet thus exhibits a fabric's characteristic porosity which is adaptive to receiving a saturating resin bonding agent of heavy oil-like consistency in its interstices thereby enhancing its ability to be secured to the surface of the wall.

Figure 10:
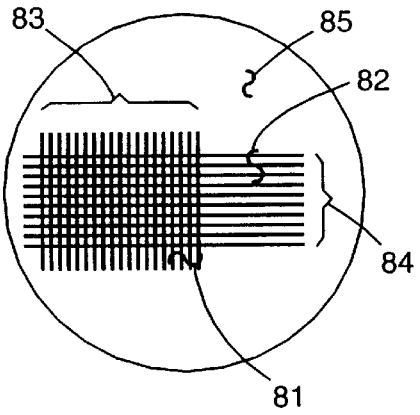
FIG. 10 is a fragmentary plan view on an enlarged scale of the sheets shown in the circled region designated FIG. 10 in FIG. 9 having two of the strengthening and waterproofing sheets disposed in superposed and orthoganal relationship to each other with portions of the sheets broken away for clarity of illustration.
Figure 11:
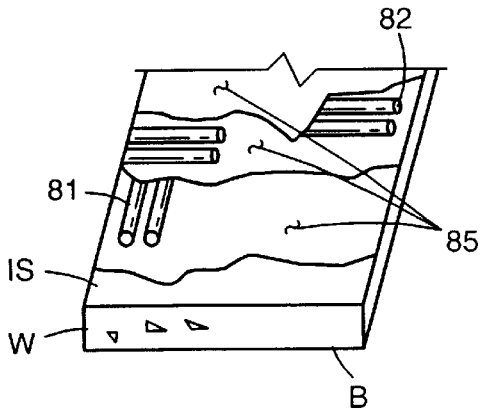
FIG. 11 is a perspective view on an enlarged scale of a portion of the strengthening and waterproofing sheets shown in FIG. 10 applied to a wall with portions thereof broken away for clarity of illustration.

While FIG. 9 diagrammatically illustrates the basic structure of the sheets 80, their structure is shown in greater detail in FIGS. 10 and 11. The two sheets are disposed in superposed relationship and are orthoganally oriented with the two layers of respective tows 81 and 82 embedded in the three layers of resin bonding agent that are identically numbered 85 since they ultimately join into a unitary matrix. The first or bottom resin layer is initially formed with a portion of the center layer and in which the fiber tows 81 are embedded thus forming one of the sheets and is the sheet that is applied first to the interior surface IS of a wall that is represented by the block B. These sheets are initially formed as structurally independent, fabric-form flexible sheets 83, 84 comprising a plurality of tows held in closely adjacent, parallel relationship by a number of interwoven filaments disposed in relatively closely spaced relationship. A layer of the resin bonding agent is spread on the wall's interior surface IS and a sheet 83 of the dry fabric is pressed into the resin. If only one sheet 80 will be used, it would be oriented with the fiber tows 81 disposed vertically to obtain their tensile strength in strengthening of a wall. Additional resin is then placed on the exposed outer surface thereby completing formation of the sheet. Where two sheets 80 are to be used as shown in FIG. 9, the second sheet is advantageously positioned with its fabric flexible sheet 84 oriented as shown in FIG. 9 having its tows 82 horizontally disposed to counteract shear forces encountered by the first sheet 80 that had been applied to the wall. Application of the second sheet proceeds in the same manner.

Application of the sheet 80 is effected by first cleaning and preparing the wall W in accordance with the technique previously described relative to another embodiment of this invention. A saturating bonding resin is then applied in a layer to a predetermined area of the wall's surface that is of a convenient working size. The sheet is then applied to the wall by pressing an appropriate sized section to the area covered by the bonding resin while it is still in an uncured state. A roller may be used to assist in applying sufficient pressure uniformly by causing the roller to traverse the sheet thereby causing the sheet to be pressed into the layer of resin and thereby resulting in some of the resin being forced through the interstices of the sheet. The amount of resin extruded through the interstices assures that the fibers forming the sheet will be bonded together in addition to being thoroughly adhered to the wall. Rolling is continued until the sheet in fixed in position. Additional bonding resin may be applied to the outer exposed surface of the sheet and rolled thereon to further assure filling the interstices in the fibers thereby enhancing their interbonding. This not only increases the waterproofing ability of the sheet but it enables the sheet to have a smooth exterior surface which facilitates cleaning in addition to enhancing aesthetic appearance.

Figure 12:
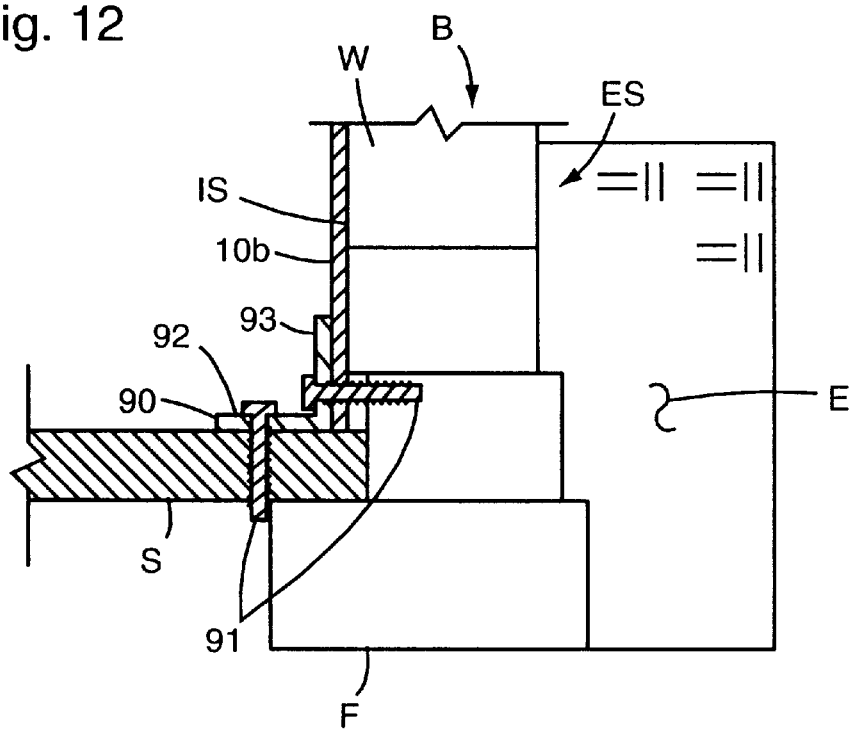
FIG. 12 is a fragmentary sectional view on an enlarged scale taken along line 12—12 of FIG. 1.
Figure 13:
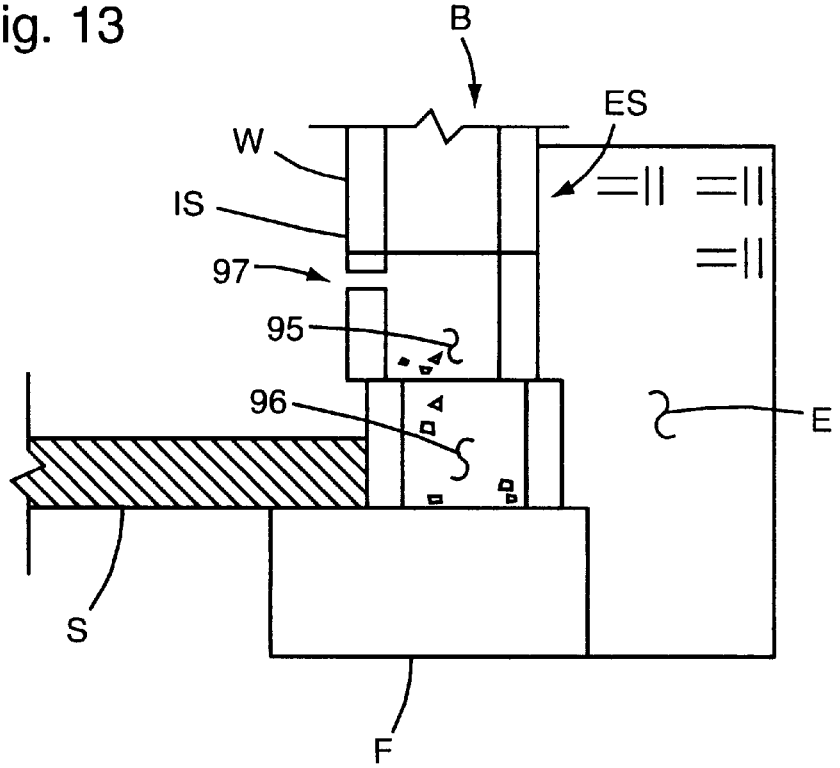
FIG. 13 is a fragmentary transverse sectional view of a bottom portion of a masonry wall showing a reinforcing technique for a wall that has incurred damage resulting from excessive latteral force applied to the wall's exterior surface.

A common failure that occurs with masonry walls W that are constructed from concrete blocks is shown in FIGS. 12 and 13 with two techniques for correcting the associated problem and designed to be utilized in conjunction with the previously described wall strengthening systems. This problem occurs as a consequence of the lowest or first tier of blocks B abutting the floor slab S which aids that tier in resisting the horizontal forces exerted laterally inward against the exterior surface ES of the wall by the surrounding earth. But, the remaining upwardly disposed tiers of blocks do not have the benefit of the floor slab's counteracting support and it is possible they may be displaced inwardly as is shown in FIGS. 12 and 13. This is particularly true with older wall constructions. Newer construction techniques tend to avoid this problem by filling the interior cores of the blocks with concrete thus increasing the strength of interconnection over that obtained from the customary mortared joints.

Referring to FIGS. 1 and 12 a technique for meeting this defect is illustrated and is hereafter described with respect to those drawing figures. The plate 10*b* is of a length to have its lower end terminate at the bottom edge of the block B in the second tier blocks. Additional reinforcement and strengthening is provided by an L-shaped plate 90 placed in this region. It has a first leg 92 positioned on and secured to the floor slab S by fastening devices 91. The second leg 93 of this plate extends a distance upwardly in parallel relationship to the wall's interior surface IS and overlaps the lower terminal end of the plate 10*b*. Fastening devices 91 are projected through this leg 93 of the plate 90 and into the underlying block B. Strengtening and waterproofing sheets 80 such as is shown in FIG. 9 may be utilized in combination with the plate 90.

FIG. 13 illustrates an alternative technique for meeting this type of wall damage and to aid in reinforcing and strengthening of a modular concrete block wall W. A grouting 95 is introduced into the cores 96 of the lowermost two tiers of blocks B where it solidifies. Holes 97 are bored through the sidewalls of the blocks for introducing the grout into the block's cores. Throughout the foregoing descriptions of the several embodiments of this invention the term "bonding adhesive" has been used in a generic sense to designate a material that is utilized in securing the reinforcing fibers in forming the strengthening plates as well as securing those plates to a wall. It is also used to designate the material used in securing other components together in forming the sheets which are applied to the wall surfaces to provide strength in combination with the plates in addition to waterproofing the masonry walls. The bonding adhesive may be of any of the several commonly available polymers such as epoxy, polyester or vinylester, for example, but these are exemplary and not to be considered limitative of the particular adhesive which is utilized in a particular installation. Since the walls that are to be reinforced or strengthened by employment of this invention are vertically oriented, it is preferable that the bonding adhesive be of form or have a consistency that prevents or at least limits downward flow of the adhesive on the wall during the time of application of the plates or sheets and providing time for curing to the extent necessary to maintain the component in place while the adhesive curing process is completed.

Utilization of the aforedescribed strengthening and waterproofing system is not limited to masonry structures or to vertical walls of such structures. It may also be utilized with either wood or metal structures, or structures fabricated of other materials, giving appropriate consideration to the mechanical characteristics of the particular material.

From the foregoing description of the several embodiments of this invention considered in conjunction with the accompanying drawings it will be readily apparent that a greatly improved wall strengthening system is disclosed. Additionally, some of the embodiments incorporate waterproofing structural features that can function independently of other wall strengthening components or can be used in cooperation with such components to enhance the wall strengthening capabilities. The rigid, fiber reinforced polymer plates provide significant tensile strength as a consequence of being fabricated with fiber strands of high tensile strength, such as carbon or glass or other filamentary material exhibiting similar high tensile strength characteristics. The wall strengthening capability of this system is greatly enhanced through combination of the plates and the waterproofing sheets. This capability is further increased through combination of two waterproofing sheets disposed in overlying relationship.

What is claimed is:

1. A reinforced wall comprising:

(a) at least one elongated, rigid, fiber-reinforced polymer plate having longitudinally oriented reinforcing fibers embedded within said plate, said plate having a first major surface rigidly secured in a substantially vertical orientation against an interior surface of the wall for mechanically strengthening the wall against a force having a component perpendicular to the wall applied to an opposite, exterior surface of the wall, said plate having a length substantially equal to the height of the wall;

(b) an adhesive interposed as a layer between said plate's first major surface and the interior surface of the wall; and (c) wherein said plate's first major surface has a plurality of protuberances projecting a distance laterally outward therefrom, said protuberances distributed throughout the first major surface of said plate, thereby increasing the effective surface area of said first major surface for enhancing the adherence capability of said adhesive.

2. The reinforced wall according to claim 1 wherein said protuberances are of a conical configuration.

3. The reinforced wall according to claim 1 wherein said protuberances are about 1/32 inch in diameter at their base and are about 1/32 inch in height.

4. The reinforced wall according to claim 1 wherein said protuberances are formed with an apex that is arcuately shaped.

5. The reinforced wall according to claim 1 wherein said plate includes a second major surface opposite to said first major surface, said second major surface being formed with a plurality of protuberances projecting a distance laterally outward therefrom and distributed throughout said second major surface thereby increasing the effective surface area of said second major surface.

6. The reinforced wall according to claim 1, further comprising a second plate having first and second opposite major surfaces, said plate having reinforcing fibers extending transverse to said first plate's longitudinal axis, said first and second plates being bonded together into a unitary structure by an adhesive placed in a layer between the opposed surfaces of the plates and cured, thereby forming an adhering interconnection therebetween.

7. The reinforced wall according to claim 6 wherein a third plate, having a structure similar to the first plate is disposed at the opposite side of said second plate from said first plate, said second and third plates being bonded together into a unitary structure by an adhesive placed in a layer between the opposed surfaces of the second and third plates and cured thereby forming an adhering interconnection therebetween.

8. The reinforced wall according to claim 1, further comprising a plurality of said rigid, fiber reinforced polymer plates disposed in vertically oriented, spaced parallel relationship along an elongated wall, and a wall strengthening and waterproofing sheet secured to the interior surface of the wall and extending between at least one pair of plates secured to the interior surface of the wall, said sheet including a fabric having a plurality of tows fabricated with a multiplicity of high tensile strength fibers extending the full length of a respective tow, said tows disposed in parallel relationship and lying in a single layer with the tows interconnected by means to maintain them in spaced parallel relationship, and a resin bonding agent impregnating said tows forming a surface layer at each side of the layer of tows, said bonding agent being in an uncured state when impregnating said layer of tows and becoming cured.

9. The reinforced wall according to claim 8 wherein a layer of said bonding agent is placed on a wall and said fabric is placed against said layer of bonding agent and pressed into it resulting in impregnation of the tows and expression of some of the bonding agent between the tows, forming a surface layer of the bonding agent on the exteriorly facing side of the tows.

10. The reinforced wall in accordance with claim 1, further comprising a strengthening and waterproofing sheet secured to the interior surface of the wall, said sheet including a fabric having a plurality of elongated tows, each tow having a multiplicity of high tensile strength fibers, and said sheet also including a bonding fluid impregnating said tows and forming a surface layer at each side of the sheet, said bonding fluid being in an uncured state when impregnating said layer of tows and then becoming cured.

11. The reinforced wall in accordance with claim 1, further comprising at least one mechanical anchor extending from the plate into the wall.

12. A method of reinforcing a wall, said wall having an interior wall surface, against a force having a component substantially perpendicular to the wall, the method comprising:

(a) disposing a first major surface of a composite plate, said plate made of a cured polymer matrix reinforced by embedded fibers, in a substantially parallel orientation relative to the interior wall surface and facing the interior wall surface;

(b) applying adhesive to at least one of said surfaces; and (c) forcing the first major surface of the plate against the interior wall surface to mechanically mount the plate in a facing relationship to the interior wall surface with the adhesive interposed between the plate and the wall in a layer.

13. The method in accordance with claim 12, further comprising preparing the interior wall surface for attachment of the plate thereto.

14. The method in accordance with claim 13, wherein the step of preparing the interior wall surface comprises removing matter from the interior wall surface by mechanically cleaning the surface.

15. The method in accordance with claim 12, further comprising applying a force to the first major surface of the rigid plate, thereby forming surface protuberances for increasing the surface area of the first major surface to enhance the adhesion of the adhesive to the first major surface.

16. The method in accordance with claim 12, further comprising mounting at least one fastener to the plate and the wall, said fastener extending into an opening in the wall.

17. The method in accordance with claim 12, further comprising applying an adhesive to the interior wall surface, and pressing a sheet of fabric, including filaments having a predetermined tensile strength, against the adhesive on the interior wall surface.

18. The method in accordance with claim 17, further comprising coating the fabric sheet with adhesive.

19. The method in accordance with claim 12, further comprising applying an adhesive to a sheet of fabric having filaments of predetermined tensile strength, and then pressing the sheet against the interior wall surface.

20. The method in accordance with claim 19, further comprising applying an adhesive to the interior wall surface.

21. The method in accordance with claim 12, wherein the wall is made of at least two substantially parallel rows of blocks adhered together, said rows having a first course abutted by a floor and a second course resting upon the first course, the method further comprising rigidly mounting a first leg of an L-shaped plate against the floor and seating a second, transverse leg of the L-shaped plate against a lower end of the composite plate, said second leg extending from said floor to above a lower edge of the second course of blocks for resisting movement of the second course of blocks caused by the force applied to the exterior surface of the wall.

22. The method in accordance with claim 12, wherein the wall is made of at least two substantially parallel rows of blocks adhered together, each of the blocks having at least one void formed therein that communicates with a chamber in an adjoining block, and said rows having a first course abutted by a floor and a second course resting upon the first course, the method further comprising:

(a) forming an opening into a void in one of the blocks that is above the first course; and (b) inserting fluent, hardenable material through the opening into the void for filling voids in all blocks in the first and at least part of the second course to subsequently harden and resist movement of the second course of blocks caused by a force applied to the exterior surface of the wall.

23. A reinforced wall made of at least two substantially parallel rows of blocks adhered together to form the wall, said rows having a first course abutted by a floor and a second course resting immediately upon the first course, said reinforced wall comprising:

(a) at least one elongated, rigid, fiber-reinforced polymer plate having longitudinally oriented reinforcing fibers embedded within said plate, said plate having a first major surface rigidly secured in a substantially vertical orientation against an interior surface of the wall for mechanically strengthening the wall against a force having a component perpendicular to the wall applied to an opposite, exterior surface of the wall, said plate having a length substantially equal to the height of the wall;

(b) an adhesive interposed as a layer between said plate's first major surface and the interior surface of the wall; and (c) an L-shaped plate having first and second transverse legs, the first leg seating against and rigidly mounted to the floor, the second leg seating against a lower end of the fiber reinforced polymer plate, said second leg extending from said floor to above a lower edge of the second course of blocks for resisting movement of the second course of blocks caused by the force applied to the exterior surface of the wall.

24. A reinforced wall made of at least two substantially parallel rows of blocks adhered together to form the wall, said rows having a first course abutted by a floor and a second course resting upon the first course, said reinforced wall comprising:

(a) a waterproofing and reinforcing sheet having a first major surface rigidly secured against an interior surface of the wall, said sheet including a fabric having a plurality of elongated tows, each tow having a multiplicity of high tensile strength fibers, and said sheet also including a cured bonding fluid impregnating said tows for mechanically strengthening the wall against a force having a component perpendicular to the wall applied to an opposite, exterior surface of the wall; and (b) an L-shaped plate having first and second transverse legs, the first leg seating against and rigidly mounted to the floor, the second leg seating against a lower end of the sheet, said second leg extending from said floor to above a lower edge of the second course of blocks for resisting movement of the second course of blocks caused by the force applied to the exterior surface of the wall.

* * * * *